US012637926B2

(12) United States Patent
Li et al.

(10) Patent No.: US 12,637,926 B2
(45) Date of Patent: May 26, 2026

(54) WELL DRILLING DEVICE FOR UNDERSEA IN-SITU EXPLOITATION OF NATURAL GAS HYDRATE

(71) Applicant: GUANGZHOU INSTITUTE OF ENERGY CONVERSION, CHINESE ACADEMY OF SCIENCES, Guangzhou (CN)

(72) Inventors: Xiaosen Li, Guangzhou (CN); Yi Wang, Guangzhou (CN); Jianwu Liu, Guangzhou (CN); Zhaoyang Chen, Guangzhou (CN); Gang Li, Guangzhou (CN); Yu Zhang, Guangzhou (CN)

(73) Assignee: GUANGZHOU INSTITUTE OF ENERGY CONVERSION, Guangzhou (CN)

( * ) Notice: Subject to any disclaimer, the term of this patent is extended or adjusted under 35 U.S.C. 154(b) by 0 days.

(21) Appl. No.: 18/922,455

(22) Filed: Oct. 22, 2024

(65) Prior Publication Data

US 2025/0347200 A1 Nov. 13, 2025

Related U.S. Application Data

(63) Continuation-in-part of application No. PCT/CN2024/094218, filed on May 20, 2024.

(30) Foreign Application Priority Data

May 9, 2024 (CN) ..... 202410568689.1

(51) Int. Cl.
*E21B 41/00* (2006.01)

(52) U.S. Cl.
CPC ..... *E21B 41/0099* (2020.05); *E21B 41/0007* (2013.01)

(58) Field of Classification Search
CPC ... E21B 7/124; E21B 41/0007; E21B 41/0099
See application file for complete search history.

(56) References Cited

U.S. PATENT DOCUMENTS 3,741,320 A * 6/1973 Hilfing ..... E21B 19/002 175/45
6,394,192 B1 * 5/2002 Frazer ..... E21B 25/00 175/58

(Continued)

FOREIGN PATENT DOCUMENTS

CN 115217417 A * 10/2022
WO WO-2017108098 A1 * 6/2017 ..... E02B 17/00

*Primary Examiner* — Matthew R Buck
(74) *Attorney, Agent, or Firm* — Bayramoglu Law Offices LLC

(57) ABSTRACT

A well drilling device for undersea in-situ exploitation of a natural gas hydrate is provided. The well drilling device includes a well drilling module, wherein the well drilling module includes a frame, a portal framed lead rail and a manipulator are mounted in the frame, a lower hydraulic tong is mounted at the bottom of the frame, an upper hydraulic tong is arranged coaxially above the lower hydraulic tong, and a coaxial space between the upper hydraulic tong and the lower hydraulic tong is a drilling column placement position; the upper hydraulic tong is mounted in a top drive, and the top drive is assembled in the portal framed lead rail to move vertically in a vertical direction of the portal framed lead rail; and a pipe rack is arranged in a rotation range of the manipulator, and is configured to store and place a drilling column.

8 Claims, 14 Drawing Sheets

(56) References Cited

U.S. PATENT DOCUMENTS

| | | | | |
|---|---|---|---|---|
| 9,322,220 | B2 * | 4/2016 | Innes | E21B 15/02 |
| 11,499,379 | B2 * | 11/2022 | Eriksen | E21B 7/132 |
| 11,512,535 | B2 * | 11/2022 | Elliot | E21B 15/02 |
| 2016/0251907 | A1 * | 9/2016 | Walker | E21B 7/124 175/5 |
| 2022/0003062 | A1 * | 1/2022 | Wiener | E21B 41/0007 |

* cited by examiner

WELL DRILLING DEVICE FOR UNDERSEA IN-SITU EXPLOITATION OF NATURAL GAS HYDRATE

CROSS REFERENCE TO THE RELATED APPLICATIONS

This application is a continuation-in-part application of International Application No. PCT/CN2024/094218, filed on May 20, 2024, which is based upon and claims priority to Chinese Patent Application No. 202410568689.1, filed on May 9, 2024, the entire contents of which are incorporated herein by reference.

TECHNICAL FIELD

The present invention relates to exploitation equipment for a natural gas hydrate, in particular to a well drilling device for undersea in-situ exploitation of a natural gas hydrate.

BACKGROUND

Although a few companies, such as the BAUER Group, British Geological Survey (BGS) and Williamson & Associates in the United States have carried out the research and development of undersea drilling and sampling apparatuses, as well as Hunan University of Science and Technology in China, there is no mature technology and device for undersea in-situ exploitation of natural gas hydrates in the world. Internationally, the undersea drilling and sampling apparatuses are classified into a first-generation undersea drilling rig, a second-generation undersea drilling rig, a third-generation undersea drilling rig and a fourth-generation undersea drilling rig.

(1) After the 1950s, undersea rigs having main features of shallow seawater (a seawater depth less than 500 m), shallow drilling (a drilling depth less than 10 m), single-function and low intelligence, which classified into the first-generation undersea drilling rig.

(2) After the 1990s, with the development and integration of technologies among the fields of drilling and exploration, mechanical and electronical, measuring and controlling, information and communication, electronic sensor and other fields, the undersea drilling rig has made a qualitative leap in the aspects of the suitable water depth, drilling depth and intelligence The suitable water depth reaches 6,000 m, and the drilling depth increases to 50 m. Battery-type, electric-driven-type and electro-hydraulic-combination-type power supplies have become preferred solutions for most undersea rigs in the world. Communication buses (information transmission lines for connecting computer information systems or computers and other systems), optical fiber and acoustics and other communication modes are adopted for communication. Monitoring and control apparatuses such as visualization units, posture instruments, propellers and leveling legs have been additionally provided. Therefore, the second-generation undersea drilling rig having main features of deep seawater, shallow drilling and excellent intelligence is produced.

(3) Since 2007, in order to improve the coring capability including burial depth, efficiency and quality in undersea drilling, the wire-line coring technology has been upgraded for undersea drilling rigs in developed countries. Because a rock core sample at the bottom can be fished by a wire-line fishing apparatus in a circular manner during wire-line coring without lifting the drilling rig, there is no need for using a casing to protect the wellbore during the operation. Therefore, the coring quality of the sample is improved, the working time is significantly reduced, and the work efficiency is obviously improved. The application of the wire-line coring technology makes it possible to use cables for in-situ testing underground. It is a common practice to use the wire-line fishing apparatus to launch a self-contained in-situ tester to the bottom of a hole to carry out testing, and the more advanced practice is to directly use an independent small underwater winch and a bearing cable to launch and recover the in-situ tester; and the former is a storage-and-forward mode, while the latter can display and record in real time. In addition, in order to obtain more information about the drilling formation, a simple logging while drilling instrument, a wellhead test and analysis instrument and sample pressure-keeping treatment are further applied. During this period, the third-generation undersea drilling rig based on technical upgrading and transformation are mainly characterized by medium-deep drilling, wire-line coring, multi-functional testing and intelligent control. Although the working seawater depth of the third-generation undersea drilling rig is equivalent to that of the second-generation undersea drilling rig, the drilling depth of the third-generation undersea drilling rig has reached 125 m and will exceed 200 m in recent years. PROD in Australia, MeBo in Germany, A-BMS, ACS and ROVDrill in the United States, and CRD100 in Canada are all prominent representatives of the third-generation undersea drilling rig.

The fourth-generation undersea drilling rig is characterized by high investment, large size and weight, and deep drilling, with a drilling depth of 600 m. Due to its huge size, the drilling rig is fully designed with the modular design idea, and all modules can be loaded and transported on land by standard containers, and completely assembled, replaced and maintained by a remotely operated vehicle (ROV) after being launching to the undersea. In order to enable the drilling operation to be completely automatic undersea, the drilling rig is further customized with a set of special automatic operation software and an expert system to deal with underwater faults, so as to ensure the efficient and reliable operation of the drilling rig in the undersea. The fourth-generation undersea drilling rig is still in the design stage.

It can be seen that at present, these undersea drilling and sampling apparatuses take undersea sampling as the first goal, and none of them can be directly applied to a well construction process in the development of the undersea natural gas hydrate, or form a stable wellbore, or carry out subsequent development technical stages.

SUMMARY

The present invention aims to overcome the shortcomings of the prior art and provide a well drilling device for undersea in-situ exploitation of a natural gas hydrate to transfer the well drilling device from an offshore platform to the undersea, so as to greatly accelerate drilling speed and reduce exploitation cost.

In order to achieve the above purpose, the technical solutions of the present invention are as follows.

A well drilling device for undersea in-situ exploitation of a natural gas hydrate includes a well drilling module, wherein the well drilling module includes a frame, a portal framed lead rail and a manipulator are mounted in the frame, a lower hydraulic tong is mounted at a bottom of the frame, an upper hydraulic tong is arranged coaxially above the lower hydraulic tong, and a coaxial space between the upper hydraulic tong and the lower hydraulic tong is a drilling column placement position; the upper hydraulic tong is mounted in a top drive, and the top drive is assembled in the portal framed lead rail to move vertically in a vertical direction of the portal framed lead rail; and pipe racks are arranged in the rotation range of the manipulator, and is configured to store and place drilling columns, and the manipulator is configured to grab a drilling column to a position between the upper hydraulic tong and the lower hydraulic tong.

Further, the pipe rack is a disc-type pipe rack; and the manipulator reciprocates between the drilling column placement position and the disc-type pipe rack in a rotating manner to complete transferring and discharge of the drilling column.

Further, when the drilling column with a drilling bit is transferred to the drilling column placement position by the manipulator, the upper hydraulic tong tightly clamps, and the lower hydraulic tong opens; and the top drive moves down, the lower hydraulic tong tightly clamps, the upper hydraulic tong opens, the top drive moves down and is buckled in rotating manner, and the lower hydraulic tong opens to complete drilling-in of a first drilling column.

Further, after the drilling-in of the first drilling column is completed, the lower hydraulic tong tightly clamps, the top drive is unbuckled and moves up, after a subsequent drilling column is transferred to the drilling column placement position by the manipulator, the upper hydraulic tong tightly clamps, the top drive moves down, and rotating connection buckled at the top of the well, the upper hydraulic tong opens, the top drive moves down and is buckled in rotating manner, and the lower hydraulic tong opens to complete continuous drilling-in of the drilling columns.

Further, the drilling column adopts well drilling with a casing, and a down-hole drilling column combination of the well drilling with the casing consists of a drilling bit having a diameter smaller than an inner diameter of the casing and a reamer capable of passing through the inner diameter of the casing and enlarging a size of a borehole to be the same as a size of the casing.

Further, toothed bars are provided on two sides of the portal framed lead rail in a vertical direction; the top drive includes a lifting and lowering motor and a rotating motor; the lifting and lowering motor is mounted in the toothed bars to enable the toothed bars to move vertically; and the rotating motor is connected to the upper hydraulic tong to drive the drilling column to rotate.

Further, four legs are further mounted at bottom four sides of the frame, and are all driven by independent hydraulic motors to extend outwards.

Further, the manipulator adopts an stand-column-type structure, the stand-column-type structure includes an stand column, and upper clamping tong and lower clamping tong are arranged on the stand column, have both a clamping function and an extending and retracting function, and are capable of acting synchronously to meet a requirement of clamping the drilling column; the stand column is capable of rotating and lifting and lowering around its central axis, so that the drilling column is transferred repeatedly between different positions; the clamping and the extending and retracting of the upper clamping tong and lower clamping tong as well as the lifting and lowering of the stand column are all driven by a hydraulic cylinder; and slewing of the stand column is driven by a hydraulic motor.

Further, the disc-type pipe rack is provided in a double/multi-layer arrangement, drilling columns between layers are attached, and after a drilling column on an outer layer is taken out, a drilling column on an inner layer is capable of automatically shifting to the outer layer; and the pipe rack is capable of rotating around its central axis and is driven by a hydraulic motor.

Further, the well drilling device for the undersea in-situ exploitation of the natural gas hydrate further includes: a seawater circulation system, wherein the seawater circulation system is configured to circulate seawater and consists of an undersea pump, a hose and a joint. The undersea pump is mounted on a frame structure of an undersea well drilling completion apparatus body, and is driven by a hydraulic motor, and cuttings circulating from the seafloor to a wellhead are transported to the seabed at a certain distance from the wellhead through the hose.

Compared with the prior art, the present invention has the following beneficial effects.

In the present invention, the loading and unloading of the drilling column are completed using the top drive, the upper hydraulic tong and the lower hydraulic tong together, and the manipulator is configured to transfer a single drilling column between a wellhead center and the pipe rack, and is arranged between the wellhead center and the pipe rack. Therefore, less equipment is arranged at the wellhead and less space is occupied, so that the space of the whole undersea in-situ well drilling completion apparatus is compact, and the well drilling device can be transferred from an offshore platform to the undersea, thereby greatly accelerating drilling speed and reducing exploitation cost.

DETAILED DESCRIPTION OF THE EMBODIMENTS

Embodiments

The followings will further describe the technical solutions of the present invention with reference to the accompanying drawings and embodiments.

Figure 1:
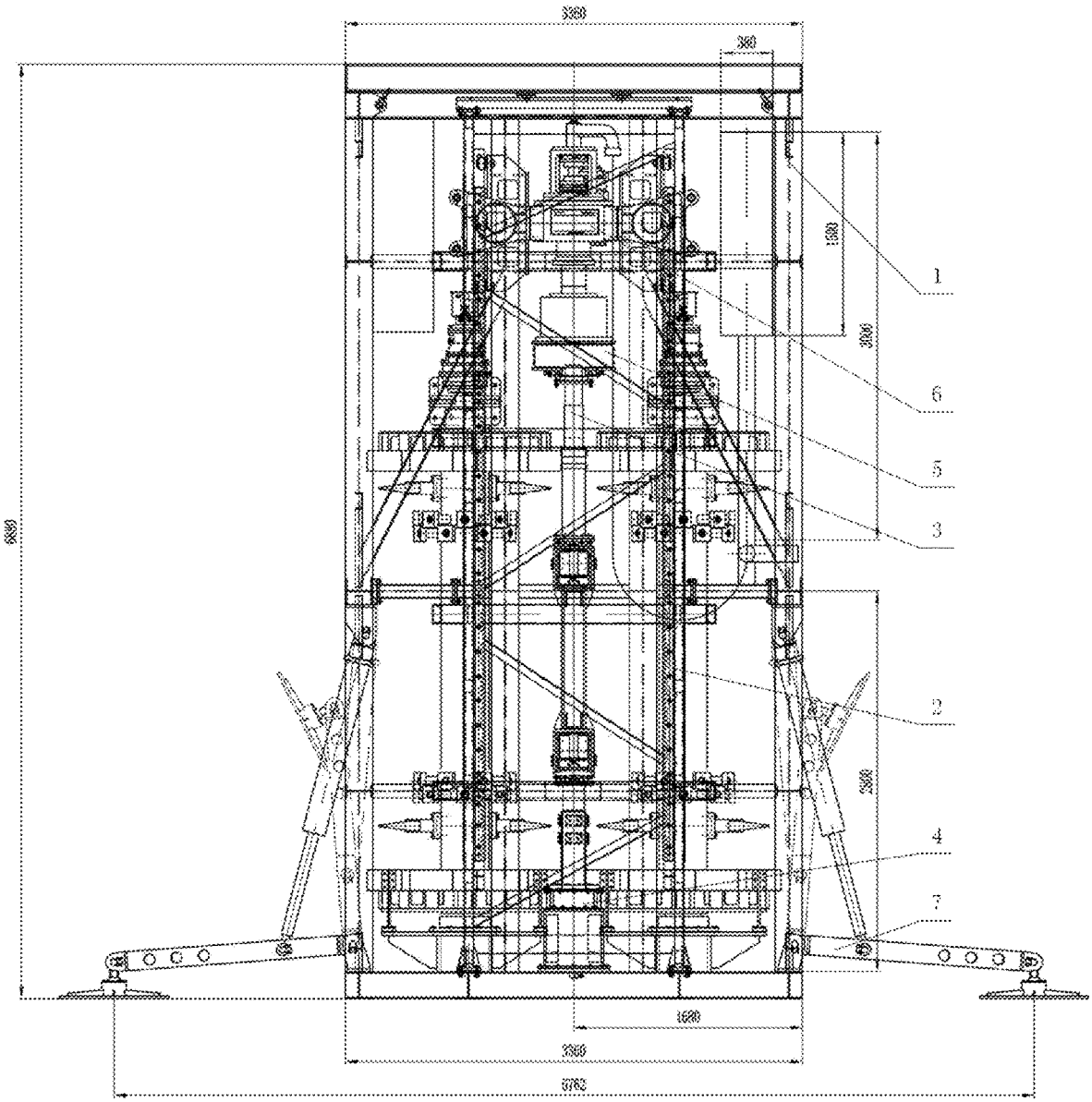
FIG. 1 is a schematic diagram of an overall structure of a well drilling module of a well drilling device for undersea in-situ exploitation of a natural gas hydrate provided by an embodiment of the present invention.
Figure 2:
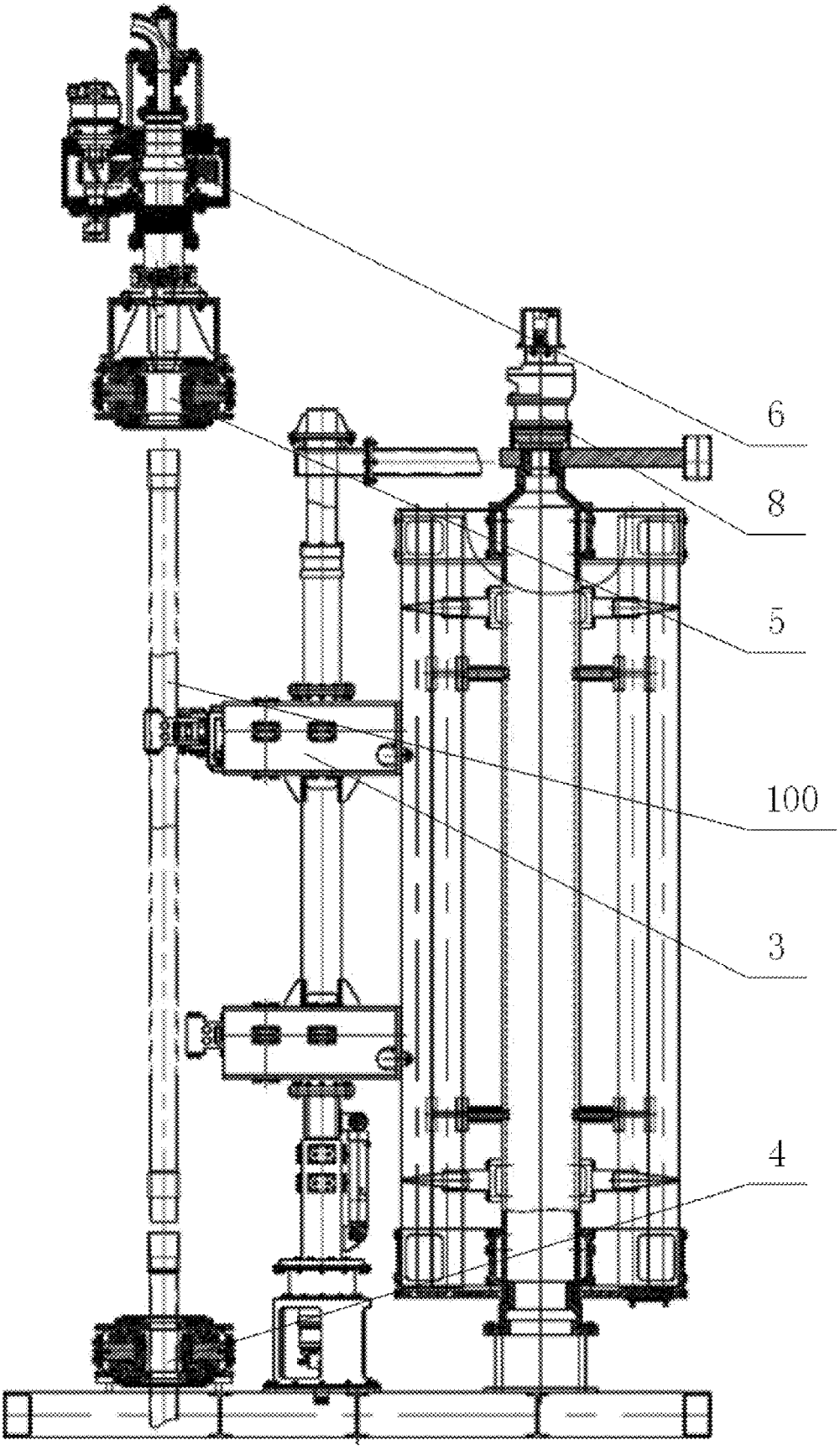
FIG. 2 is a schematic arrangement diagram of a manipulator.

Referring to FIG. 1, a well drilling device for undersea in-situ exploitation of a natural gas hydrate provided by the present embodiment mainly includes a well drilling module. The well drilling module includes a frame 1. A portal framed lead rail 2 and a manipulator 3 are mounted in the frame 1, a lower hydraulic tong 4 is mounted at the bottom of the frame 1, an upper hydraulic tong 5 is arranged coaxially above the lower hydraulic tong 4, and a coaxial space between the upper hydraulic tong 5 and the lower hydraulic tong 4 is a drilling column 100 placement position, namely, the center position of a wellhead. The upper hydraulic tong 5 is connected to a central pipe of a top drive 6, and rotates along with the central pipe. The top drive 6 is assembled in the portal framed lead rail 2 to move vertically in the vertical direction of the portal framed lead rail 2. A pipe rack 8 is arranged in a rotation range of the manipulator 3, and is configured to store and place a drilling column 100. The manipulator 3 is configured to grab the drilling column 100 to the position between the upper hydraulic tong 5 and the lower hydraulic tong 4. In this way, as shown in FIG. 2, the loading and unloading of the drilling column 100 are completed using the top drive 6, the upper hydraulic tong 5 and the lower hydraulic tong 4 together, and the manipulator 3 is configured to transfer a single drilling column 100 between a wellhead center and the pipe rack 8, and is arranged between the wellhead center and the pipe rack 8. Therefore, less equipment arranged at the wellhead and occupies less space, so that the space of the whole undersea in-situ well drilling completion apparatus is compact.

Figure 3A:
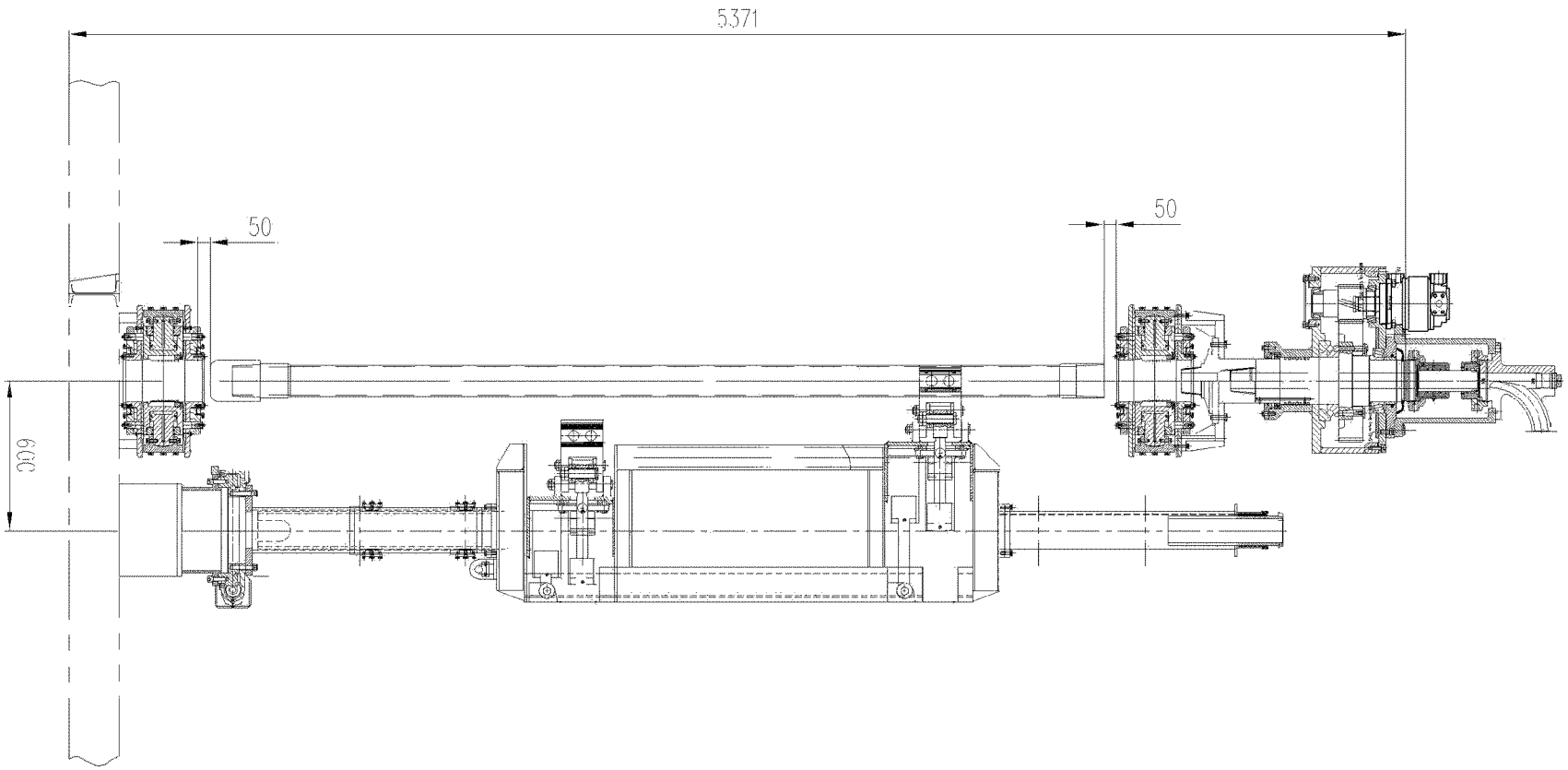
FIGS. 3A-3F show a flow chart of transferring, loading and unloading, and drilling-in operations of a drilling column.
Figure 3B:
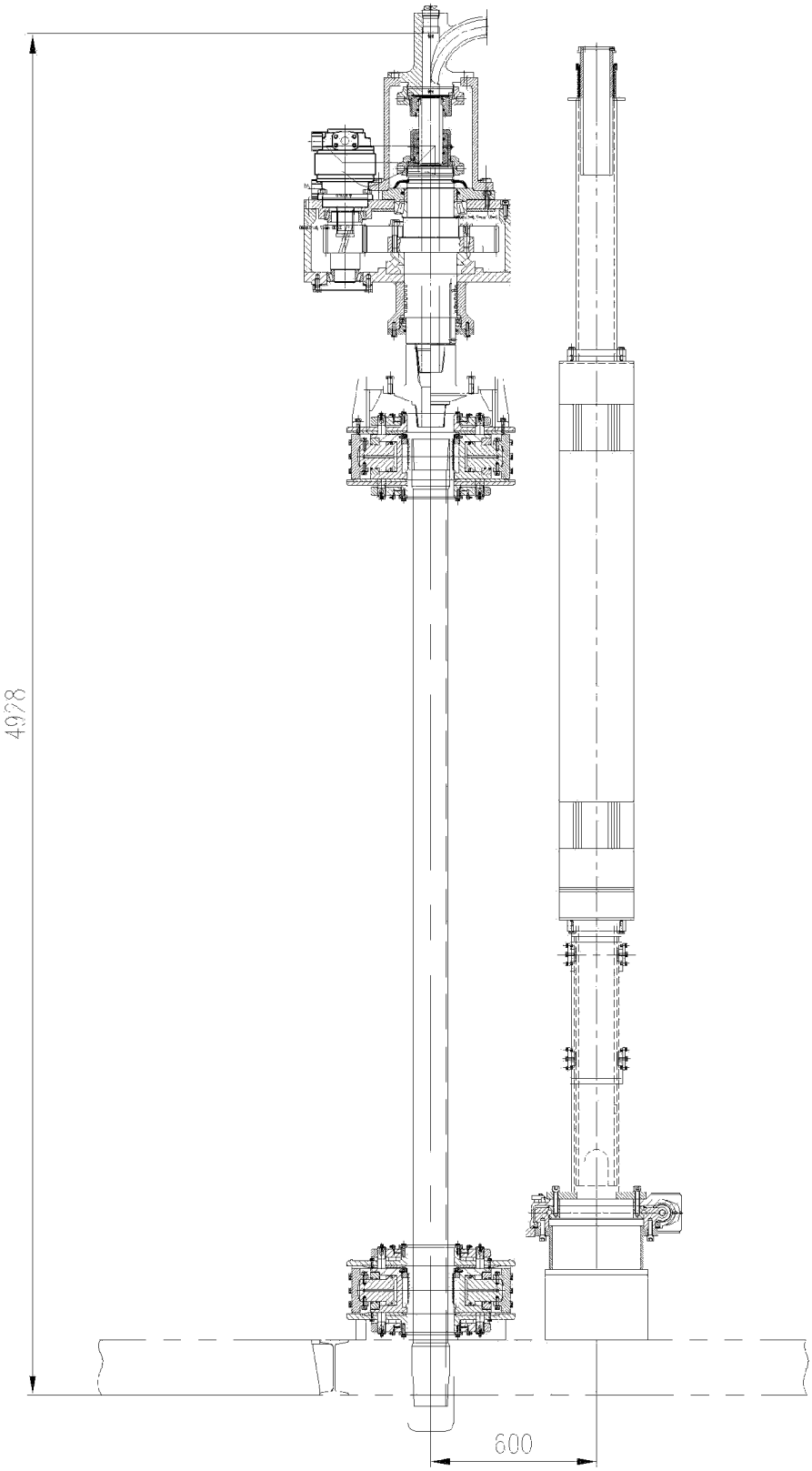
Figure 3C:
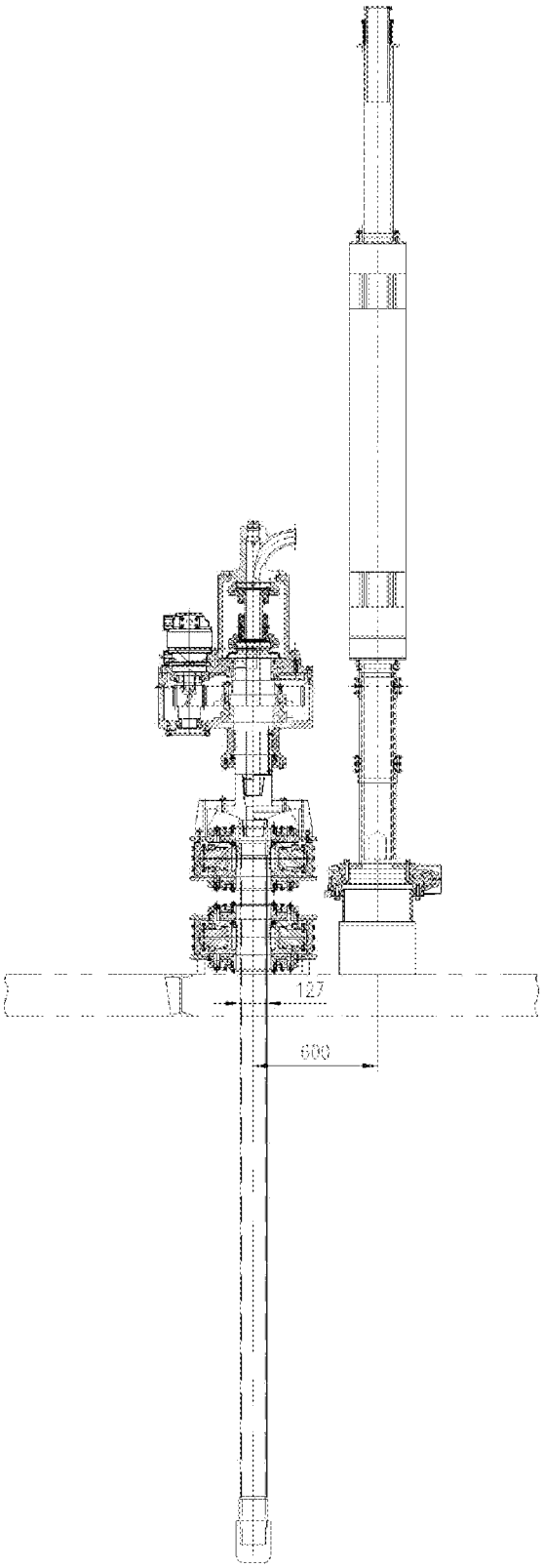
Figure 3D:
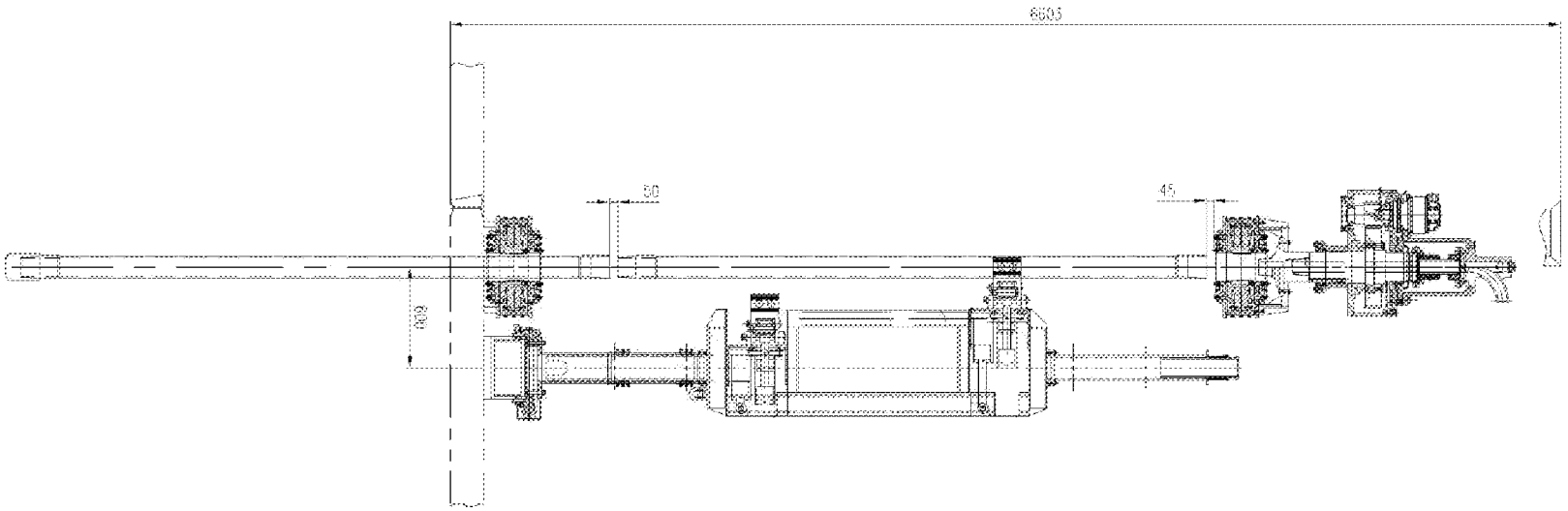
Figure 3E:
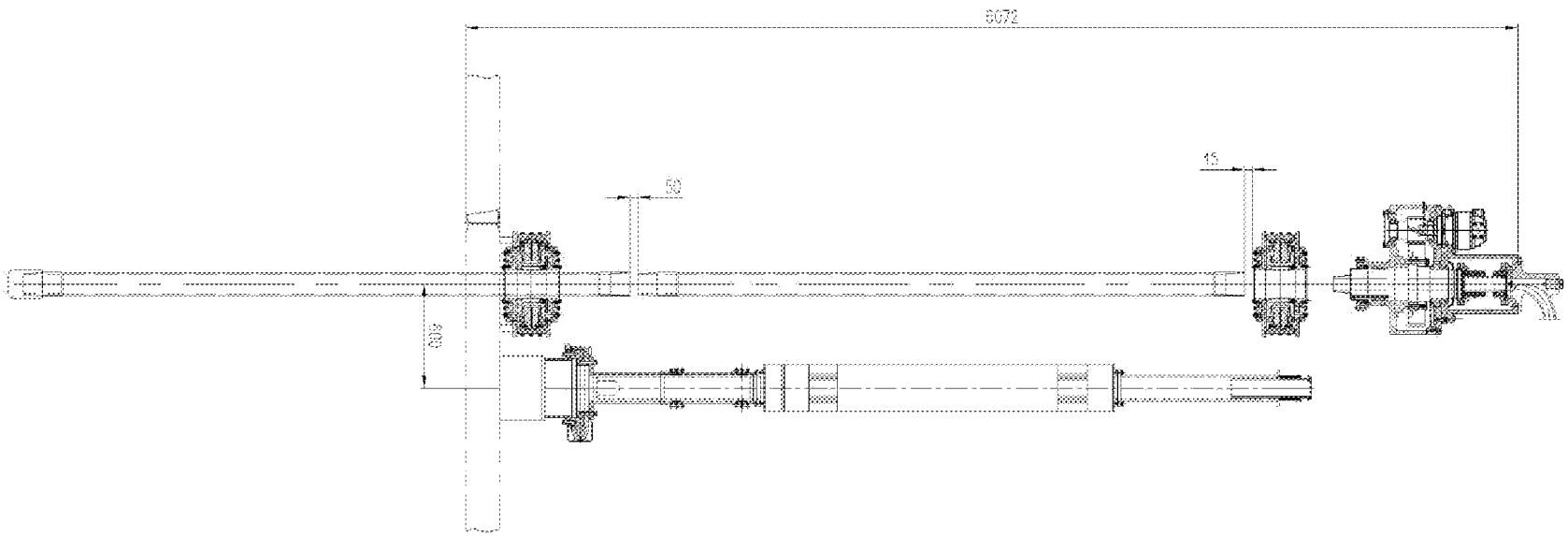
Figure 3F:
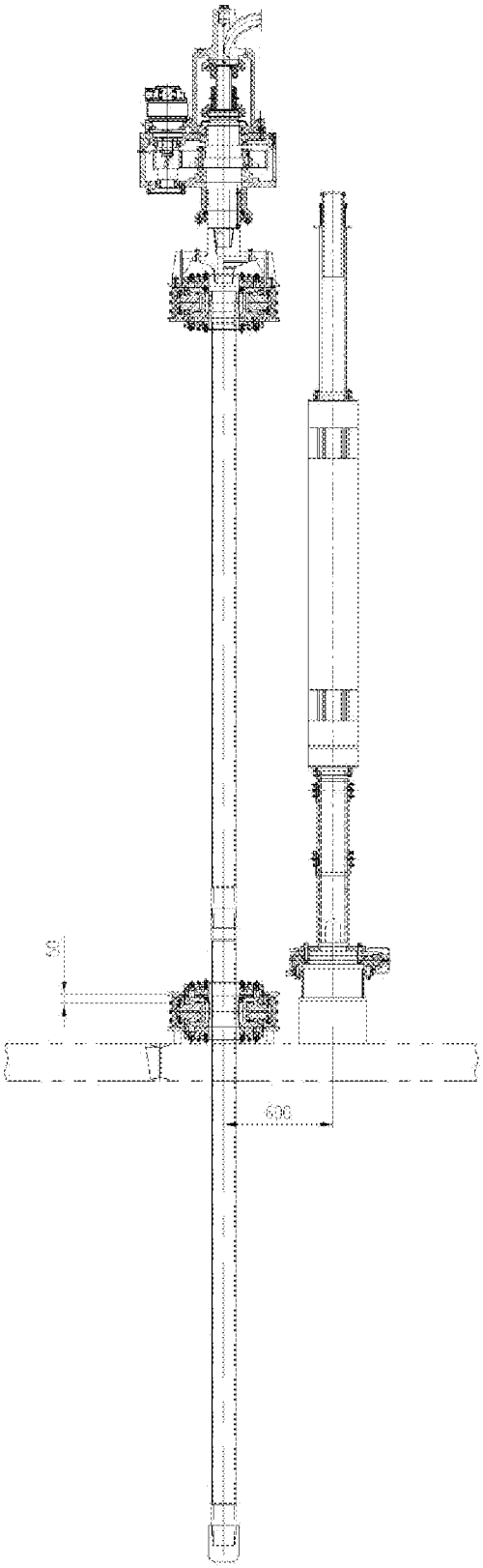

As shown in FIGS. 3A-3F, when the drilling column 100 with a drilling bit is transferred to the drilling column 100 placement position by the manipulator 3, as shown in FIG. 3A, the upper hydraulic tong 5 tightly clamps and the lower hydraulic tong 4 opens. Then, as shown in FIG. 3B, the top drive 6 moves down, the lower hydraulic tong 4 tightly clamps, the upper hydraulic tong 5 opens, and the top drive 6 moves down and is buckled in rotating manner. Then, as shown in FIG. 3C, the lower hydraulic tong 4 opens, the top drive 6 drills in, the lower hydraulic tong 4 tightly clamps, and the top drive 6 is unbuckled to complete the drilling-in of the first drilling column. After the drilling-in of the first drilling column is completed, as shown in FIG. 3D, the top drive 6 moves up, and the manipulator 3 transfers the second drilling column to the wellhead center. As shown in FIG. 3E, the top drive 6 moves down, the upper hydraulic tong 5 tightly clamps, and the top drive 6 moves down, and rotating connection buckled at the top of the well. As shown in FIG. 3F, the upper hydraulic tong 5 opens, the top drive 6 moves down, and rotating connection buckled at the upper part, and the lower hydraulic tong 4 opens to wait for a next drilling column 100 to be transferred. In this way, the flow of transferring, loading and unloading, and drilling-in operations of the drilling columns 100 can be achieved.

Figure 4:
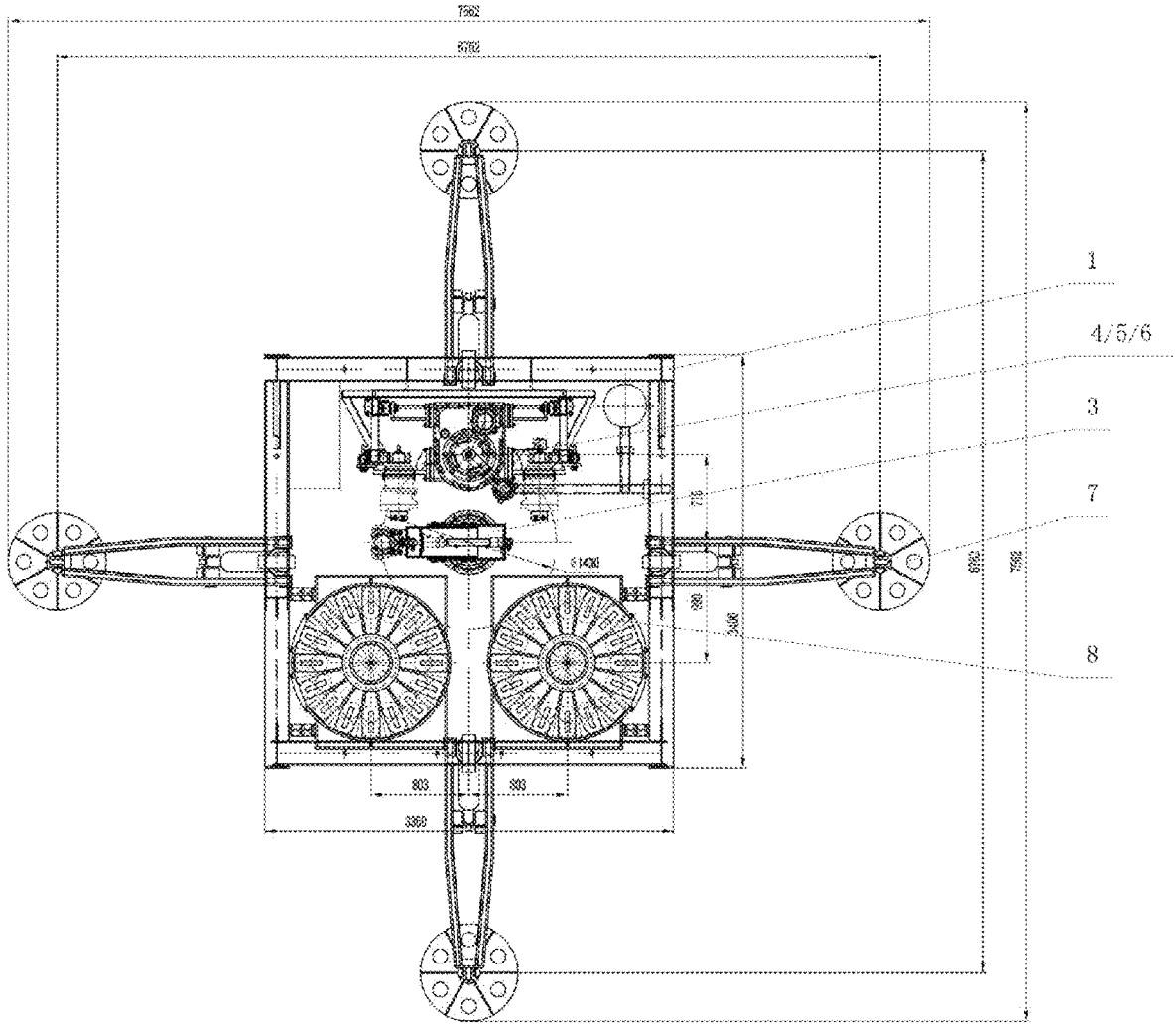
FIG. 4 is a top view of a well drilling device for undersea in-situ exploitation of a natural gas hydrate provided by an embodiment of the present invention.
Figure 5:
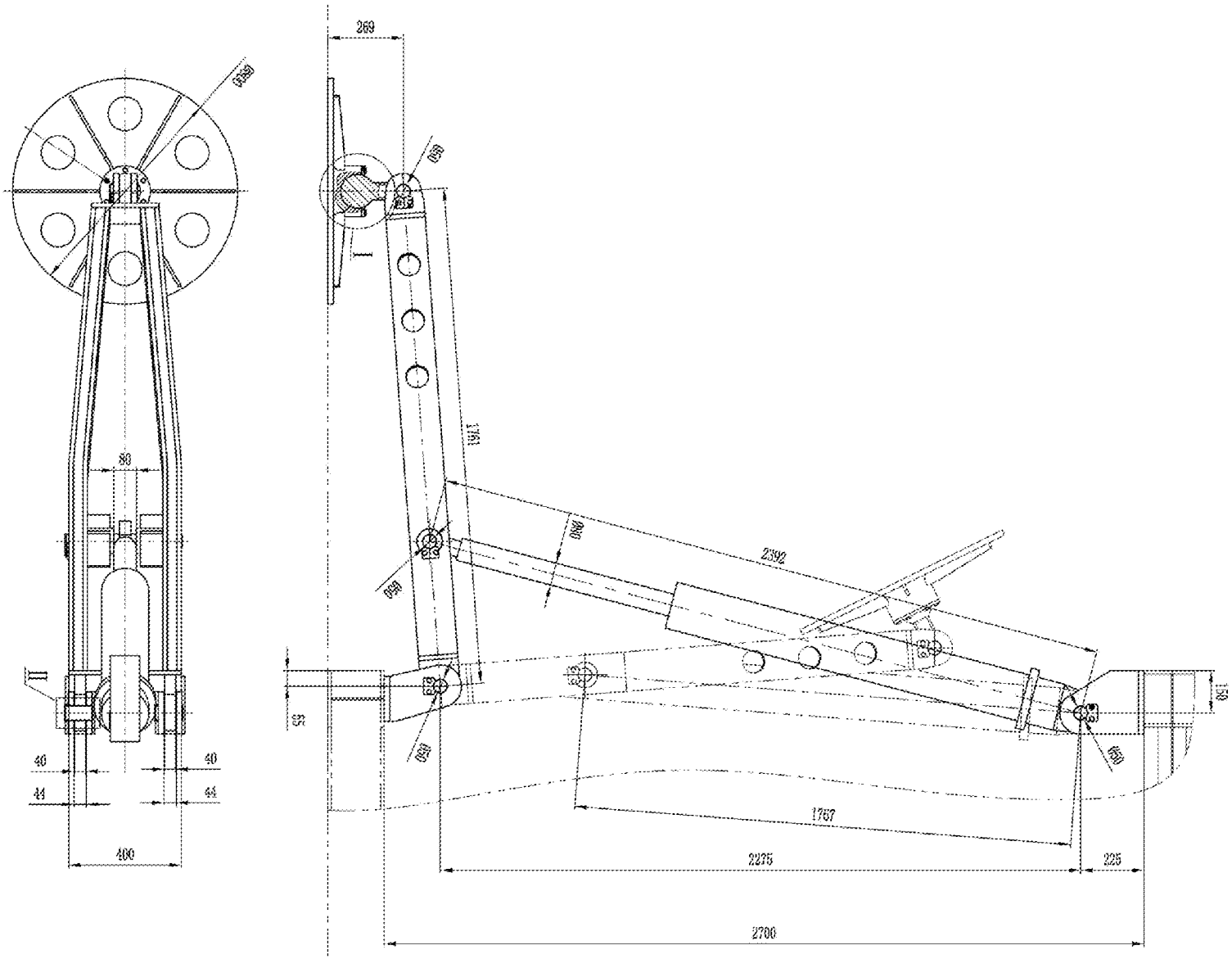
FIG. 5 is a schematic diagram of states of a leveling leg.

As a preference of the present embodiment, as shown in FIG. 4, leveling legs 7 are further mounted at the bottom four sides of the frame 1, and are all driven by independent hydraulic motors to extend outwards. As shown in FIG. 5, the leveling leg 7 is driven by an oil cylinder to extend outwards, has a large adjustment range, and can greatly expand a grounding area to increase stability to play the role of leveling chassis and stable support. In this way, during a process that the well drilling device for the undersea in-situ exploitation of the natural gas hydrate is launched to the undersea, the supporting and self-leveling of the well drilling device are achieved through the four legs with adjustable power, so as to avoid lateral slip or posture change of the well drilling device itself in subsequent actions.

Figure 6:
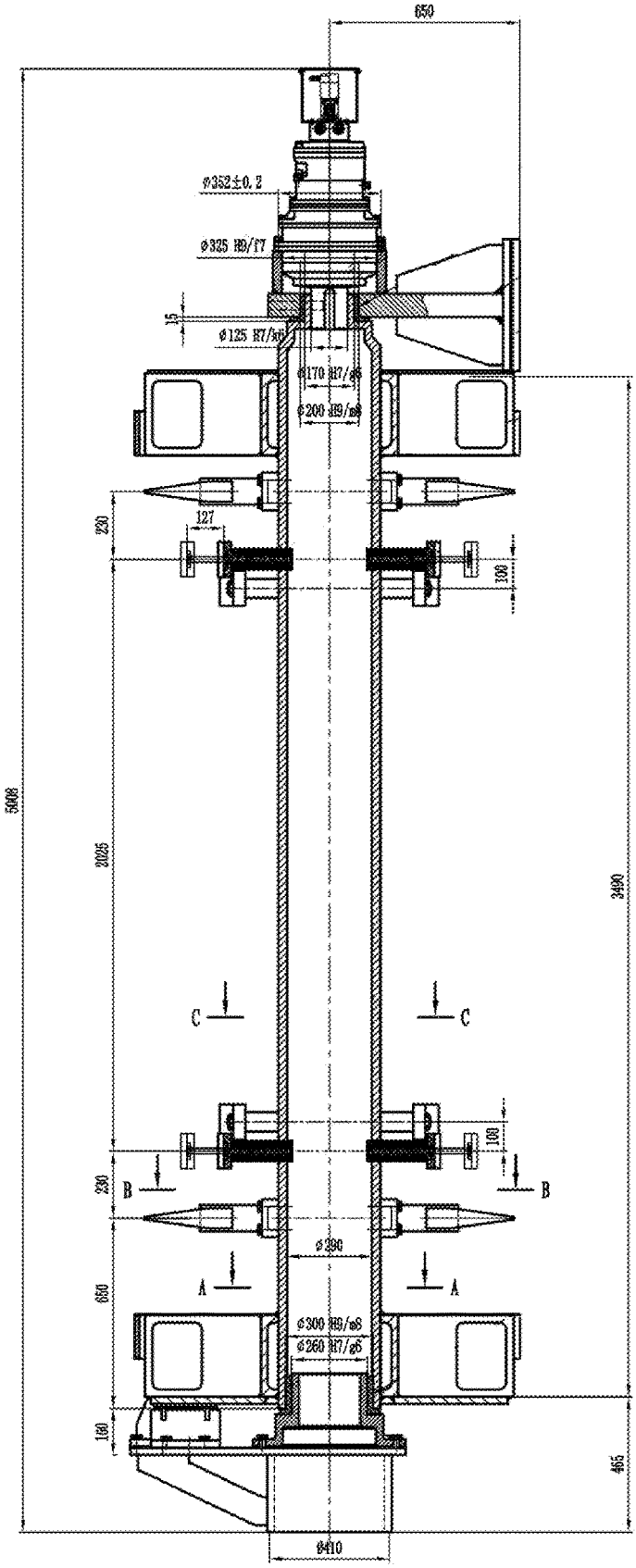
FIG. 6 is a schematic diagram of a pipe rack without a drilling column.

In a specific embodiment, as shown in FIG. 6, the pipe rack 8 is a disc-shaped pipe rack and is provided with two or more. The manipulator 3 reciprocates between the drilling column 100 placement position and the disc-type pipe racks in a rotating manner to complete the transferring of the drilling column 100. In this way, by arranging the manipulator 3 between the two disc-shaped pipe racks 8 and in the center of the whole device, a requirement of repeated transmitting of the drilling columns 100 between the two pipe racks 8 and the wellhead center can be met, which simplifies the structure of an undersea drilling rig. As shown in FIGS. 3A-3F, the disc-type pipe rack adopts a double-layer arrangement of the drilling columns 100, and the drilling columns 100 between layers are closely attached. After a drilling column 100 on the outer layer is taken out, a drilling column 100 on the inner layer can automatically shift to the outer layer. The pipe rack can rotate around its central axis and is driven by a hydraulic motor. In this way, the automatic discharge of the drilling column 100 can be achieved. The upper hydraulic tong 5 and the lower hydraulic tong 4 have the same structural form. Three hydraulic cylinders are used to clamp the drilling column 100, and are evenly distributed on the same plane at angles of 120°. In addition, a synchronous movement mechanism is provided to meet a centering requirement when the drilling column 100 is clamped. In this way, the automatic loading and unloading of the drilling column 100 can be achieved.

Figure 7:
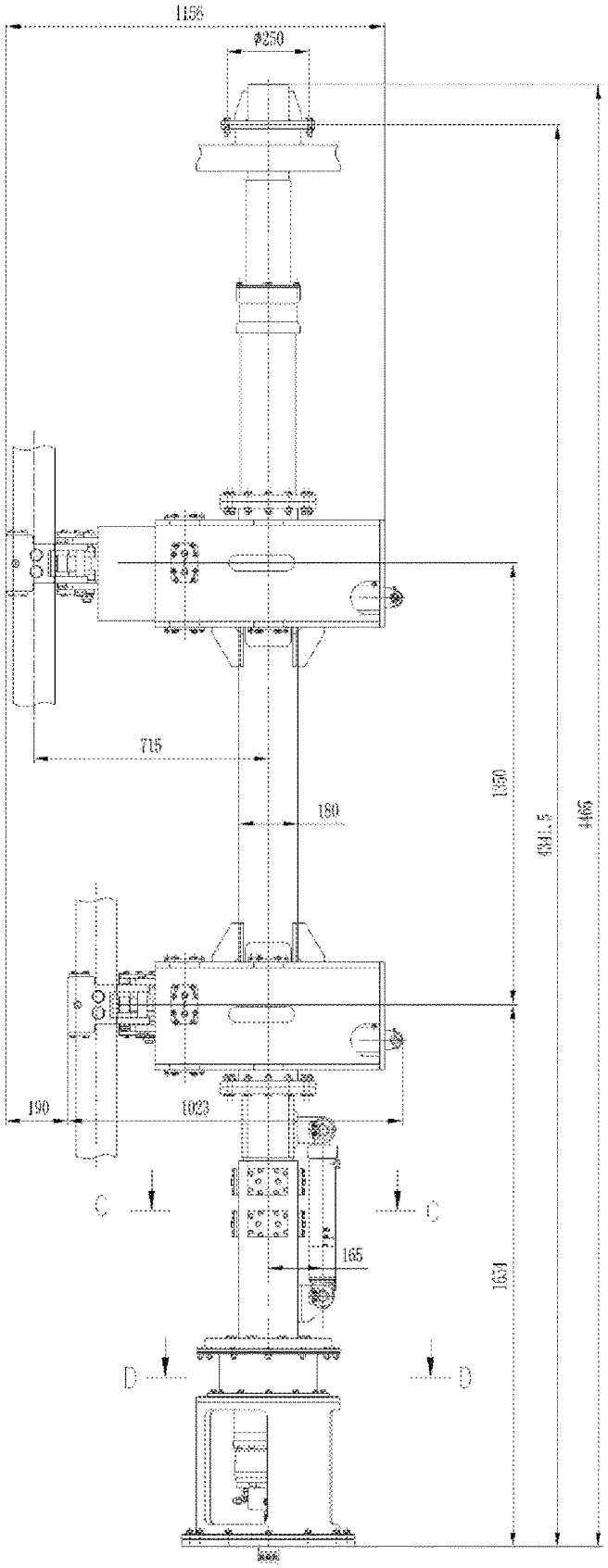
FIG. 7 is a schematic structural diagram of a manipulator.

In a specific embodiment, as shown in FIG. 7, the manipulator 3 adopts an stand-column-type structure, including a stand column 31. The upper clamping tong 32 and the lower clamping tong 33 are arranged on the stand column 31, have both a clamping function and an extending and retracting function, and can synchronously act to meet a requirement of clamping the drilling column 100. The stand column 31 can rotate and lift and lower around its own central axis, so that the drilling column 100 is transferred repeatedly between different positions. The clamping and the extending and retracting of the upper clamping tong 32 and the lower clamping tong 33 are all driven by hydraulic cylinders. The slewing of the stand column 31 is driven by a hydraulic motor.

In a specific embodiment, the drilling column 100 adopts well drilling with a casing, and a down-hole drilling column 100 combination of the well drilling with the casing consists of a drilling bit having a diameter smaller than an inner diameter of the casing and a reamer capable of passing through the inner diameter of the casing and enlarging the size of a borehole to be the same as the size of the casing. In this way, the well drilling and the casing running are carried out simultaneously, so there is no risk that the casing cannot be run due to the collapse of a borehole wall. The casing has a large outer diameter, so that a small annular space is formed between the casing and the borehole wall; the lifting speed of cuttings is high; it is less liable to settlement; and the required displacement of the undersea pump is small.

Figure 8:
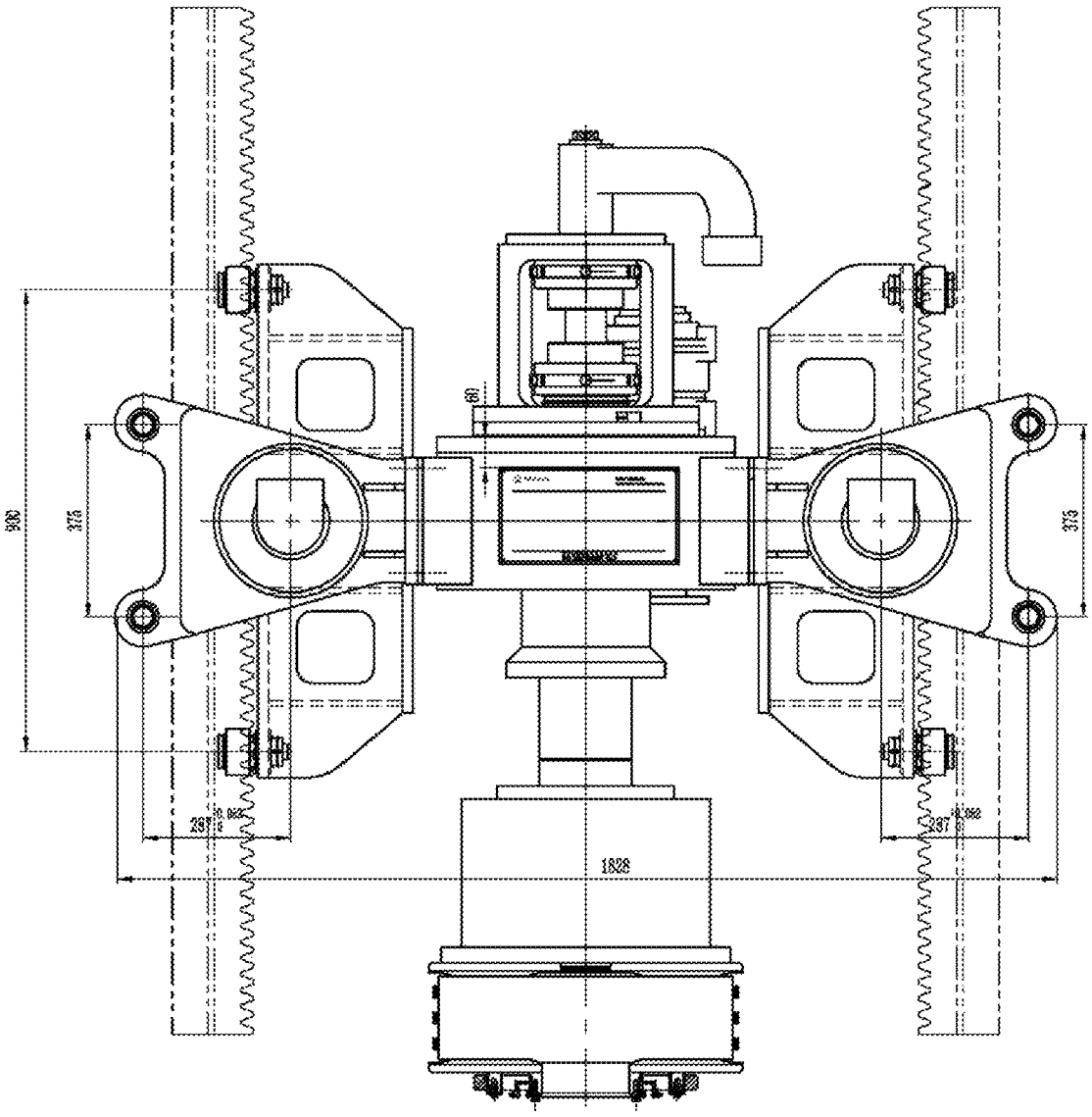
FIG. 8 is a schematic structural diagram of a top drive.

In a specific embodiment, toothed bars are provided on two sides of the portal framed lead rail 2 in the vertical direction. As shown in FIG. 8, the top drive 6 includes a lifting and lowering motor 61 and a rotating motor 62. The lifting and lowering motor 61 is mounted in the toothed bars of the portal framed lead rail 2 to enable the toothed bars to move vertically. The rotating motor 62 is connected to the upper hydraulic tong 5 to drive the drilling column 100 to rotate. In other words, the top drive 6 is driven by the hydraulic motor to move vertically, achieves transmission by a pinion and rack, and has the advantages of a simple structure, stable transmission, convenient pressurization and easy control.

Figure 9:
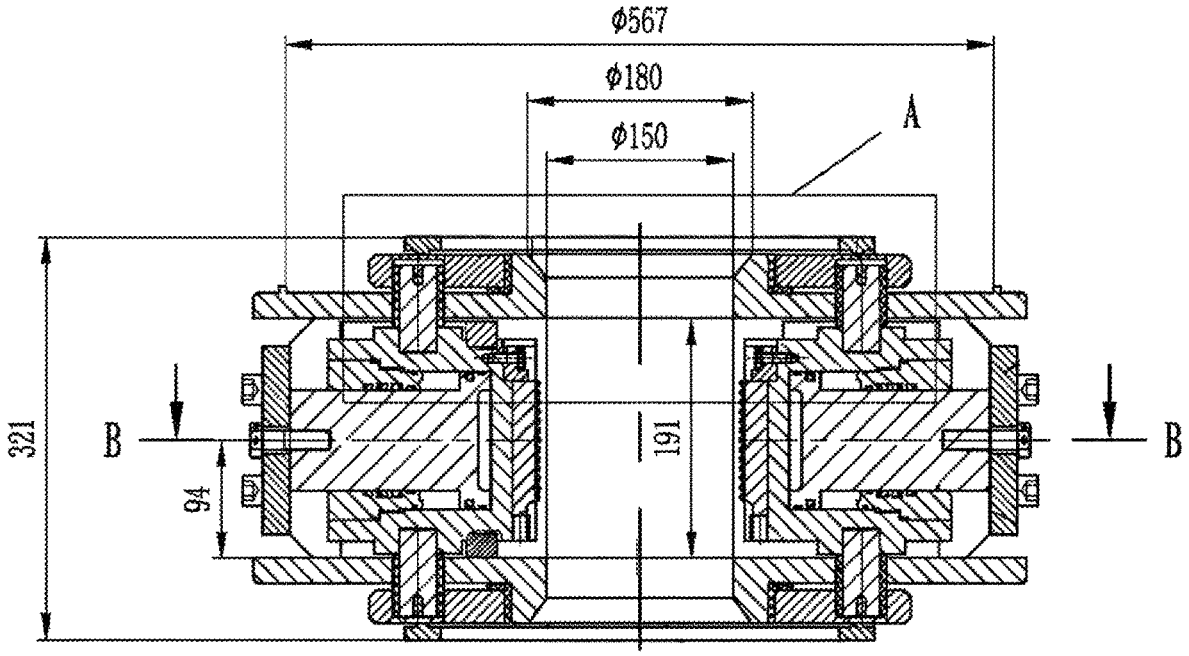
FIG. 9 is a schematic structural diagram of an upper hydraulic tong and a lower hydraulic tong; and Reference numerals: 1, frame; 2, portal framed lead rail; 3, manipulator; 4, lower hydraulic tong; 5, upper hydraulic tong; 6, top drive; 7, leveling leg; 8, pipe rack; 31, stand column; 32, upper clamping tong; 33, lower clamping tong; 61, lifting and lowering motor; 62, rotating motor; and 100, drilling column.

In a specific embodiment, as shown in FIG. 9, the upper hydraulic tong 5 and the lower hydraulic tong 4 have the same structural form. Three hydraulic cylinders are used to clamp the drilling column 100 and are evenly distributed on the same plane at angles of 120°. In addition, a synchronous movement mechanism is provided to meet a centering requirement when the drilling column 100 is clamped.

As the preferred well drilling device for the undersea in-situ exploitation of the natural gas hydrate provided by the present embodiment, the device further includes a seawater circulation system. The seawater circulation system is configured to circulate seawater, plays the role of cooling the drilling bit and carrying cuttings, and consists of an undersea pump, a hose and a joint. The cuttings circulating from the seafloor to the wellhead are transported to the undersea at a certain distance from the wellhead through the hose.

As the further preferred well drilling device for the undersea in-situ exploitation of the natural gas hydrate provided by the present embodiment, a pipe storage module, an additional module, a well cementation module and a well completion module may be further connected around the well drilling module to achieve the completely automatic undersea exploitation.

In the specific application of the well drilling device for the undersea in-situ exploitation of the natural gas hydrate, the well drilling device is carried by a water surface support vessel with the ability of launching of a deep-water device to a target sea area, and is launched by a launching apparatus of the water surface support vessel; and the connection between the well drilling device and the water surface support vessel is established through an umbilical cable with the bearing ability, so that the well drilling device is transferred from the offshore platform to the undersea, thereby greatly accelerating the drilling speed and reducing the production cost. Meanwhile, the influence of marine climate conditions on the undersea in-situ well drilling is reduced, and obvious advantages and excellent feasibility are shown.

The above embodiments are only for illustrating the technical conception and features of the present invention, and their purpose is to enable those skilled in the art to understand the content of the present invention and to implement it accordingly, without limiting the protection scope of the present invention. Any equivalent changes or modifications made in accordance with the essence of the content of the present invention shall be included in the protection scope of the present invention.

What is claimed is:

1. A well drilling device for undersea in-situ exploitation of a natural gas hydrate, comprising: a well drilling module, wherein the well drilling module comprises a frame, wherein a portal framed lead rail and a manipulator are mounted in the frame, a lower hydraulic tong is mounted at a bottom of the frame, an upper hydraulic tong is arranged coaxially above the lower hydraulic tong, and a coaxial space between the upper hydraulic tong and the lower hydraulic tong is a drilling column placement position; the upper hydraulic tong is mounted in a top drive, and the top drive is assembled in the portal framed lead rail to move vertically in a vertical direction of the portal framed lead rail; and a pipe rack is arranged in a rotation range of the manipulator, the pipe rack is configured to store and place a drilling column, and the manipulator is configured to grab the drilling column to a position between the upper hydraulic tong and the lower hydraulic tong;

wherein when the drilling column with a drilling bit is transferred to the drilling column placement position by the manipulator, the upper hydraulic tong tightly clamps, and the lower hydraulic tong opens; and the top drive moves down, the lower hydraulic tong tightly clamps, the upper hydraulic tong opens, the top drive moves down and is buckled in a rotating manner, and the lower hydraulic tong opens to complete drilling-in of a first drilling column;

wherein after the drilling-in of the first drilling column is completed, the lower hydraulic tong tightly clamps, the top drive is unbuckled and moves up, after a subsequent drilling column is transferred to the drilling column placement position by the manipulator, the upper hydraulic tong tightly clamps, the top drive moves down, and rotating connection buckled at a top of a well, the upper hydraulic tong opens, the top drive moves down and is buckled in the rotating manner, and the lower hydraulic tong opens to complete continuous drilling-in of the drilling columns;

wherein the drilling column adopts well drilling with a casing, and a down-hole drilling column combination of the well drilling with the casing comprises a drilling bit having a diameter smaller than an inner diameter of the casing and a reamer configured for passing through the inner diameter of the casing and enlarging a size of a borehole to be equal to a size of the casing; and wherein four legs are further mounted at bottom four sides of the frame, and are all driven by independent hydraulic motors to extend outwards.

2. The well drilling device for the undersea in-situ exploitation of the natural gas hydrate according to claim 1, wherein the pipe rack is a disc-type pipe rack; and the manipulator reciprocates between the drilling column placement position and the disc-type pipe rack in a rotating manner to complete transferring and discharge of the drilling column.

3. The well drilling device for the undersea in-situ exploitation of the natural gas hydrate according to claim 1, wherein toothed bars are provided on two sides of the portal framed lead rail in the vertical direction; the top drive comprises a lifting and lowering motor and a rotating motor; the lifting and lowering motor is mounted in the toothed bars to allow the toothed bars to move vertically; and the rotating motor is connected to the upper hydraulic tong to drive the drilling column to rotate.

4. The well drilling device for the undersea in-situ exploitation of the natural gas hydrate according to claim 1, wherein the manipulator adopts an stand-column-type structure, the stand-column-type structure comprises a stand column, wherein an upper clamping tong and a lower clamping tong are arranged on the stand column, have both a clamping function and an extending and retracting function, and are configured for acting synchronously to meet a requirement of clamping the drilling column; the stand column is configured for rotating and lifting and lowering around a central axis of the stand column, so that the drilling column is transferred repeatedly between different positions; clamping and extending and retracting of the upper clamping tong and the lower clamping tong as well as lifting and lowering of the stand column are all driven by a hydraulic cylinder; slewing of the stand column is driven by a hydraulic motor.

5. The well drilling device for the undersea in-situ exploitation of the natural gas hydrate according to claim 2, wherein the disc-type pipe rack is provided in a double/multi-layer arrangement, and after a drilling column on an outer layer is taken out, a drilling column on an inner layer is allowed for automatically shifting to the outer layer; and the disc-type pipe rack is configured for rotating around a central axis of the disc-type pipe rack and is driven by a hydraulic motor.

6. The well drilling device for the undersea in-situ exploitation of the natural gas hydrate according to claim 1, further comprising: a seawater circulation system, wherein the seawater circulation system is configured to circulate seawater and comprises an undersea pump, a hose, and a joint; and the undersea pump is mounted on a frame structure of an undersea well drilling completion apparatus body, and is driven by a hydraulic motor, and cuttings circulating from seafloor to a wellhead are transported to a seabed at a predetermined distance from the wellhead through the hose.

7. The well drilling device for the undersea in-situ exploitation of the natural gas hydrate according to claim 2, wherein when the drilling column with a drilling bit is transferred to the drilling column placement position by the manipulator, the upper hydraulic tong tightly clamps, and the lower hydraulic tong opens; and the top drive moves down, the lower hydraulic tong tightly clamps, the upper hydraulic tong opens, the top drive moves down and is buckled in the rotating manner, and the lower hydraulic tong opens to complete drilling-in of a first drilling column.

8. The well drilling device for the undersea in-situ exploitation of the natural gas hydrate according to claim 7, wherein after the drilling-in of the first drilling column is completed, the lower hydraulic tong tightly clamps, the top drive is unbuckled and moves up, after a subsequent drilling column is transferred to the drilling column placement position by the manipulator, the upper hydraulic tong tightly clamps, the top drive moves down, and rotating connection buckled at a top of a well, the upper hydraulic tong opens, the top drive moves down and is buckled in the rotating manner, and the lower hydraulic tong opens to complete continuous drilling-in of the drilling columns.

* * * * *